US006291350B1

(12) United States Patent
Hashimoto et al.

(10) Patent No.: US 6,291,350 B1
(45) **Date of Patent: *Sep. 18, 2001**

(54) METHOD OF POLISHING SEMICONDUCTOR WAFER

(75) Inventors: Shin Hashimoto; Yuichi Miyoshi, both of Osaka (JP)

(73) Assignee: Matsushita Electronics Corporation, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/127,819

(22) Filed: Aug. 3, 1998

(30) Foreign Application Priority Data

Apr. 9, 1997 (JP) ..... 9-239496

(51) Int. Cl.[7] ..... H01L 21/302

(52) U.S. Cl. ..... 438/692; 438/693; 456/345; 451/286

(58) Field of Search ..... 438/690, 691, 438/692, 693, 959; 156/345; 451/286, 287, 288

(56) References Cited

U.S. PATENT DOCUMENTS 5,035,363 * 7/1991 Somoza ..... 241/1
5,245,796 9/1993 Miller et al. ..... 51/283
5,399,234 * 3/1995 Yu et al. ..... 156/636
5,664,990 * 9/1997 Adams et al. ..... 451/60
5,895,550 * 4/1999 Andreas ..... 156/345
5,989,105 * 11/1999 Kawakawaguchi et al. ..... 451/44

FOREIGN PATENT DOCUMENTS 08255774 10/1996 (JP) .

* cited by examiner

*Primary Examiner*—Benjamin L. Utech
*Assistant Examiner*—Kin-Chan Chen
(74) *Attorney, Agent, or Firm*—McDermott, Will & Emery

(57) ABSTRACT

An ultrasonic transmitting unit transmits an ultrasonic wave to a slurry supply pipe. A polishing slurry is conveyed under pressure from a slurry supply tank to a slurry outlet via the slurry supply pipe and supplied from the slurry outlet to a surface of a polishing cloth. A wafer carrier holding a semiconductor wafer presses a surface of the semiconductor wafer against the surface of the polishing cloth coated with the polishing slurry and moves the semiconductor wafer relative to the polishing cloth to polish the surface of the semiconductor wafer. A discharged slurry flown out of the surface of the polishing cloth is discharged via a discharged slurry pipe. The application of the ultrasonic wave allows abrasive particles agglomerated in the polishing slurry in the slurry supply pipe to be re-dispersed into individual forms in the polishing slurry.

3 Claims, 10 Drawing Sheets

METHOD OF POLISHING SEMICONDUCTOR WAFER

BACKGROUND OF THE INVENTION

The present invention relates to a method of performing chemical mechanical polishing in a planarization process during the manufacture of a semiconductor wafer or a semiconductor integrated circuit formed on the semiconductor wafer.

To planarize a surface of a semiconductor wafer with stepped portions formed thereon in the process of manufacturing the wafer or to planarize a circuit pattern with rugged surface topography produced in the process of manufacturing a semiconductor integrated circuit, there has recently been used chemical mechanical polishing (hereinafter referred to as CMP). Referring to FIG. 7, a conventional apparatus for polishing a semiconductor wafer by using CMP will be described. FIG. 7 shows a structure of the conventional apparatus for polishing a semiconductor wafer, in which a slurry supply tank 1 reserves therein a polishing slurry 2A which is a coloidal-suspensiontype polishing slurry containing abrasive particles in the solution. The polishing slurry 2A reserved in the slurry supply tank 1 is conveyed under pressure through a slurry supply pipe 4 by a slurry feed pump 3 and supplied from a slurry outlet 5 to a surface of a polishing cloth 7 affixed to a flat and smooth surface of a polishing platen 6 such that the surface of the polishing cloth 7 is coated with a polishing slurry 2B supplied thereto. A semiconductor wafer 9 held by a wafer carrier 8 has a surface pressed against the surface of the polishing cloth 7 and performs relative movement, such as rotation or translation, between the wafer carrier 8 and the polishing platen 6, whereby the surface of the semiconductor wafer 9 is polished. A discharged slurry containing the polishing slurry discharged from the surface of the polishing cloth during polishing is received by a discharged slurry receptacle 10 and drained through a discharged slurry pipe 11.

However, the conventional apparatus with the structure described above has encountered the problem of agglomeration of a plurality of abrasive particles in the polishing slurry. When the pH is held constant, the surfaces of the abrasive particles in the polishing slurry are normally charged to have the same polarity, so that the polishing particles repel one another by electrostatic repulsion to be uniformly dispersed and floated in the polishing slurry. However, since the polishing slurry is a coloidal solution containing the abrasive particles, it forms a viscous flow when conveyed under pressure from the slurry supply tank 1 through the slurry supply pipe 4. This causes a friction between the polishing slurry 2A and the inner wall of the slurry supply pipe 4 and a friction within the polishing slurry 2A so that the charged state on the surfaces of the abrasive particles is changed thereby. On some occasions, the abrasive particles may be attracted to each other by an electrostatic force and agglomerated, resulting in an apparently single particle with a large diameter formed of the agglomerated abrasive particles.

Likewise, the charged state on the surfaces of the abrasive particles is also changed by the friction between the polishing slurry 2B and the polishing cloth 7 during polishing, which may cause the agglomeration of the abrasive particles and produce an apparently single particle with a large diameter formed of the agglomerated abrasive particles.

Furthermore, an abrupt pH change during the water-washing of the polishing cloth 7 also induces a change in the charged state on the surfaces of the abrasive particles, which may cause the agglomeration of the abrasive particles and produce an apparently single particle with a large diameter formed of the agglomerated abrasive particles.

A description will be given to the phenomenon of agglomeration of the abrasive particles with reference to FIGS. 7 to 10. FIG. 8 shows the distribution of the diameters of the abrasive particles in the polishing slurry 2A charged into the slurry supply tank 1 shown in FIG. 7, i.e., the initial distribution of the diameters of the particles. It is assumed that the abrasive particles contained in the polishing slurry 2A are composed of commercially available coloidal silica. FIG. 9 shows the distribution of the diameters of the particles in the polishing slurry 2B collected from the slurry outlet 5 shown in FIG. 7. FIG. 10 shows the distribution of the diameters of the particles remaining on the surface of the polishing cloth 7 after a plurality of silicon wafers with respective oxide films were polished by the apparatus f or polishing a semiconductor wafer shown in FIG. 7. From the comparison between the distributions of the diameters of the particles shown in FIGS. 8 to 10, the following findings were achieved. Specifically, it was found from the comparison between FIGS. 8 and 9 that the polishing slurry 2B supplied from the slurry supply tank 1 through the slurry supply pipe 4 contained particles with diameters larger than the diameters of the particles initially contained in the polishing slurry. This indicates that the abrasive particles started to agglomerate while the polishing slurry flew through the slurry supply pipe 4, not that the individual particles were increased in size. Therefore, the particle having a large diameter of 3.0 to 10 $\mu$m shown in FIG. 9 is a single particle formed of a plurality of agglomerated abrasive particles. It was also found from the comparison between FIGS. 9 and 10 that the particles remaining on the surface of the polishing cloth 7 include particles with much larger diameters than the particles contained in the polishing slurry 2B supplied to the surface of the polishing cloth 7 and that the agglomerated abrasive particles were increased in number. This indicates that the agglomeration of the abrasive particles newly occurred during polishing and proceeded in conjunction the agglomeration of the abrasive particles occurred prior to polishing. The abrasive particles agglomerated during the CMP process not only renders polishing properties including a polishing rate unstable but also causes a scratch on the surface of the semiconductor wafer 9 as a workpiece to be polished. Since the scratch may lead to a pattern defect during the process of forming a circuit pattern after the CMP process, the yield of the semiconductor integrated circuit as well as the yield of the semiconductor wafer are reduced.

SUMMARY OF THE INVENTION

In view of the foregoing, it is therefore an object of the present invention to provide a method of polishing a semiconductor wafer which allows desired polishing properties to be maintained without causing a scratch on a surface of the semiconductor wafer even when abrasive particles in a polishing slurry are agglomerated.

To attain the above object, a first method of polishing a semiconductor wafer is a method of polishing a semiconductor wafer by using a polishing slurry having abrasive particles therein, the method comprising the steps of: supplying the polishing slurry to a surface of a polishing cloth via a supply path; pressing a surface of the semiconductor wafer against the surface of the polishing cloth supplied with the polishing slurry, moving the semiconductor wafer relative to the polishing cloth, and thereby polishing the surface of the semiconductor wafer; and applying an ultrasonic oscillation to the polishing slurry on the supply path.

The method ensures the application of the ultrasonic oscillation to the abrasive particles in the polishing slurry supplied via the supply path.

In the above method of polishing a semiconductor wafer, the step of applying the ultrasonic oscillation preferably includes re-dispersing the agglomerated abrasive particles in the polishing slurry with the application of the ultrasonic oscillation to the polishing slurry.

The method ensures the application of the ultrasonic oscillation to the abrasive particles in the polishing slurry supplied via the supply path and the re-dispersion of the agglomerated abrasive particles in the polishing slurry. As a result, the abrasive particles agglomerated on the supply path are re-dispersed into the original abrasive particles, which are supplied to the surface of the polishing cloth. This allows the surface of the semiconductor wafer to be polished with stable polishing properties without causing a scratch on the surface of the semiconductor wafer.

In the above method of polishing a semiconductor wafer, the step of supplying the polishing slurry may include conveying the polishing slurry under pressure over the supply path.

The method ensures the supply of the polishing slurry to the surface of the polishing cloth.

A second method of polishing a semiconductor wafer according to the present invention is a method of polishing a semiconductor wafer by using a polishing slurry having abrasive particles therein, the method comprising the steps of: supplying the polishing slurry to a surface of a polishing cloth; pressing a surface of the semiconductor wafer against the surface of the polishing cloth supplied with the polishing slurry, moving the semiconductor wafer relative to the polishing cloth, and thereby polishing the surface of the semiconductor wafer; and applying an ultrasonic oscillation to the polishing slurry supplied to the surface of the polishing cloth by using an ultrasonic transmitting unit and thereby re-dispersing the agglomerated abrasive particles in the polishing slurry.

The method ensures the application of the ultrasonic oscillation to the polishing slurry present on the surface of the polishing cloth and the re-dispersion of the abrasive particles agglomerated in the polishing slurry into the original polishing particles. This allows the surface of the semiconductor wafer to be polished with stable polishing properties without causing a scratch on the surface of the semiconductor wafer.

In the above method of polishing a semiconductor wafer, the step of re-dispersing the agglomerated abrasive particles may include applying the ultrasonic oscillation to the polishing slurry with the ultrasonic transmitting unit moving along the surface of the polishing cloth while being kept in contact therewith.

In accordance with the method, the abrasive particles agglomerated in the polishing slurry can be re-dispersed more positively with the application of the ultrasonic oscillation to the polishing slurry present over the entire surface of the polishing cloth.

A third method of polishing a semiconductor wafer according to the present invention is a method of polishing a semiconductor wafer by using a polishing slurry having abrasive particles therein, the method comprising the steps of: supplying the polishing slurry to a surface of a polishing cloth via a supply path; pressing a surface of the semiconductor wafer against the surface of the polishing cloth supplied with the polishing slurry, moving the semiconductor wafer relative to the polishing cloth, and thereby polishing the surface of the semiconductor wafer; discharging a discharged slurry flown out of the surface of the polishing pad via a discharge path and refluxing the discharged slurry to the supply path; and applying an ultrasonic oscillation to the discharged slurry on the discharge path.

The method ensures the application of the ultrasonic oscillation to the abrasive particles in the discharged slurry discharged via the discharge path and refluxed to the supply path.

In the above method of polishing a semiconductor wafer, the step of applying an ultrasonic oscillation preferably includes re-dispersing the agglomerated abrasive particles in the discharged slurry with the application of the ultrasonic oscillation to the discharged slurry.

The method ensures the application of the ultrasonic oscillation to the discharged slurry discharged via the discharge path and refluxed to the supply path and the re-dispersion of the abrasive particles agglomerated in the discharged slurry. As a result, the abrasive particles agglomerated on the discharge path are re-dispersed into the original abrasive particles, which are refluxed to the supply path. This allows the surface of the semiconductor wafer to be polished with stable polishing properties, while effectively utilizing the discharged slurry, without causing a scratch on the surface of the semiconductor wafer.

According to the present invention, an apparatus for polishing a semiconductor wafer is provided with an ultrasonic transmitting unit for transmitting an ultrasonic wave on a path extending from a slurry supply pipe to a slurry discharge pipe such that the ultrasonic wave is transmitted along the path prior to polishing, during polishing or after polishing. The arrangement allows the re-dispersion of the agglomerated abrasive particles present in the polishing slurry on the path or on the surface of the polishing cloth. Consequently, the agglomerated abrasive particles can be prevented from causing a scratch on a surface of the semiconductor wafer, while the polishing properties including the polishing rate can be stabilized.

According to the present invention, the discharged slurry is reused as the polishing slurry after the ultrasonic wave is transmitted to the discharged slurry so as to re-disperse the abrasive particles agglomerated in the discharged slurry. This suppresses a scratch on the surface of the semiconductor wafer, stabilizes the polishing properties such as the polishing rate, and reduces the amount of the polishing slurry consumed and discharged.

DETAILED DESCRIPTION OF THE INVENTION

EMBODIMENT 1

Figure 1:
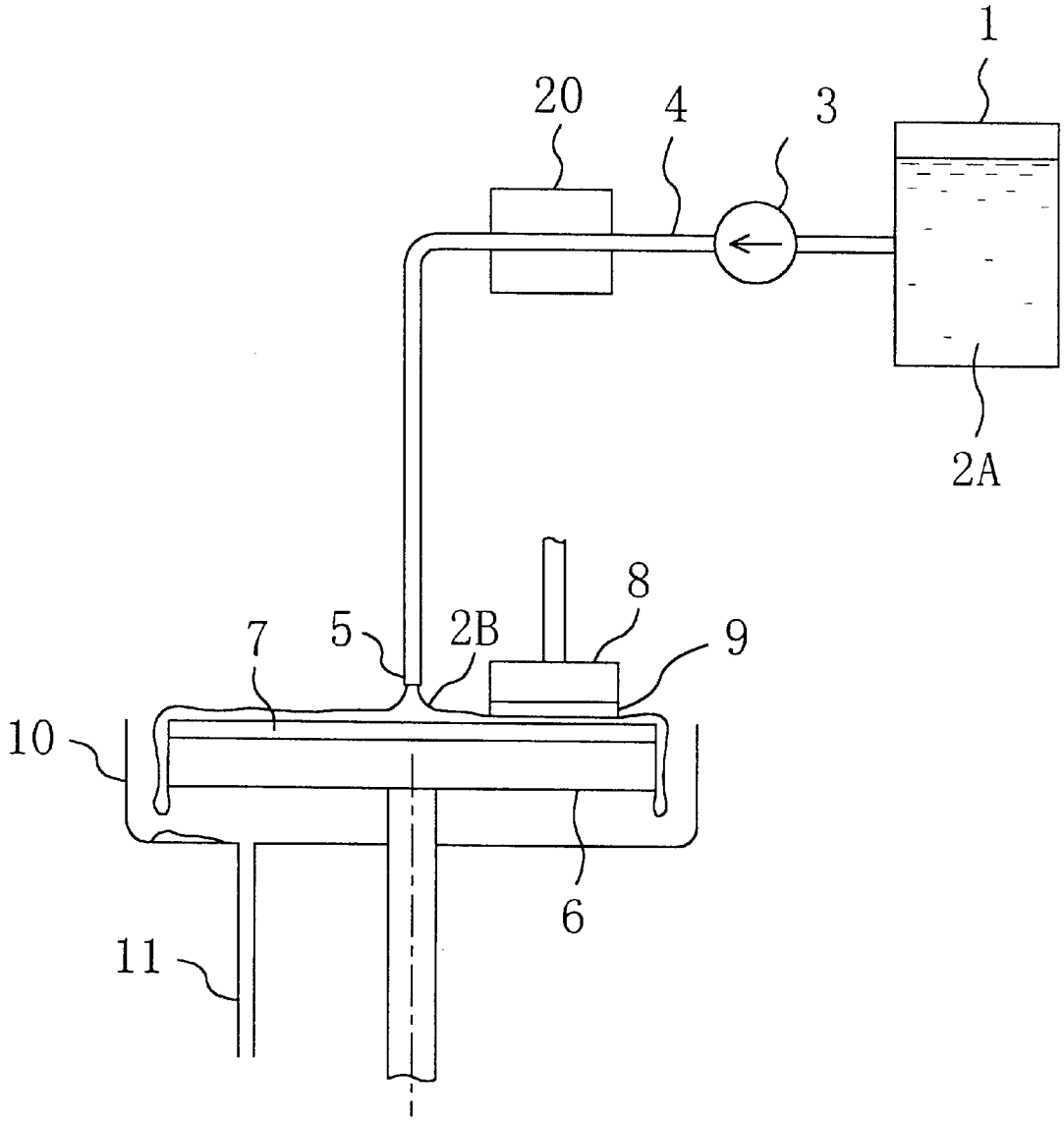
FIG. 1 shows a structure of an apparatus for polishing a semiconductor wafer to be used in a method of polishing a semiconductor wafer according to a first embodiment of the present invention.

A method of polishing a semiconductor wafer according to a first embodiment of the present invention will be described with reference to FIGS. 1 and 2. FIG. 1 shows a structure of an apparatus for polishing a semiconductor wafer to be used in the method of polishing a semiconductor wafer according to the first embodiment. The description of the same components as used in the conventional apparatus for polishing a semiconductor wafer will be omitted by providing the same reference numerals. An ultrasonic transmitting unit 20 diagrammatically shown in FIG. 1 is means for transmitting an ultrasonic wave provided on a portion of a slurry supply pipe 4. The ultrasonic transmitting unit 20 generates an ultrasonic wave and transmits, via the slurry supply pipe 4, the generated ultrasonic wave to a polishing slurry 2A conveyed under pressure through the slurry supply pipe 4.

Figure 2:
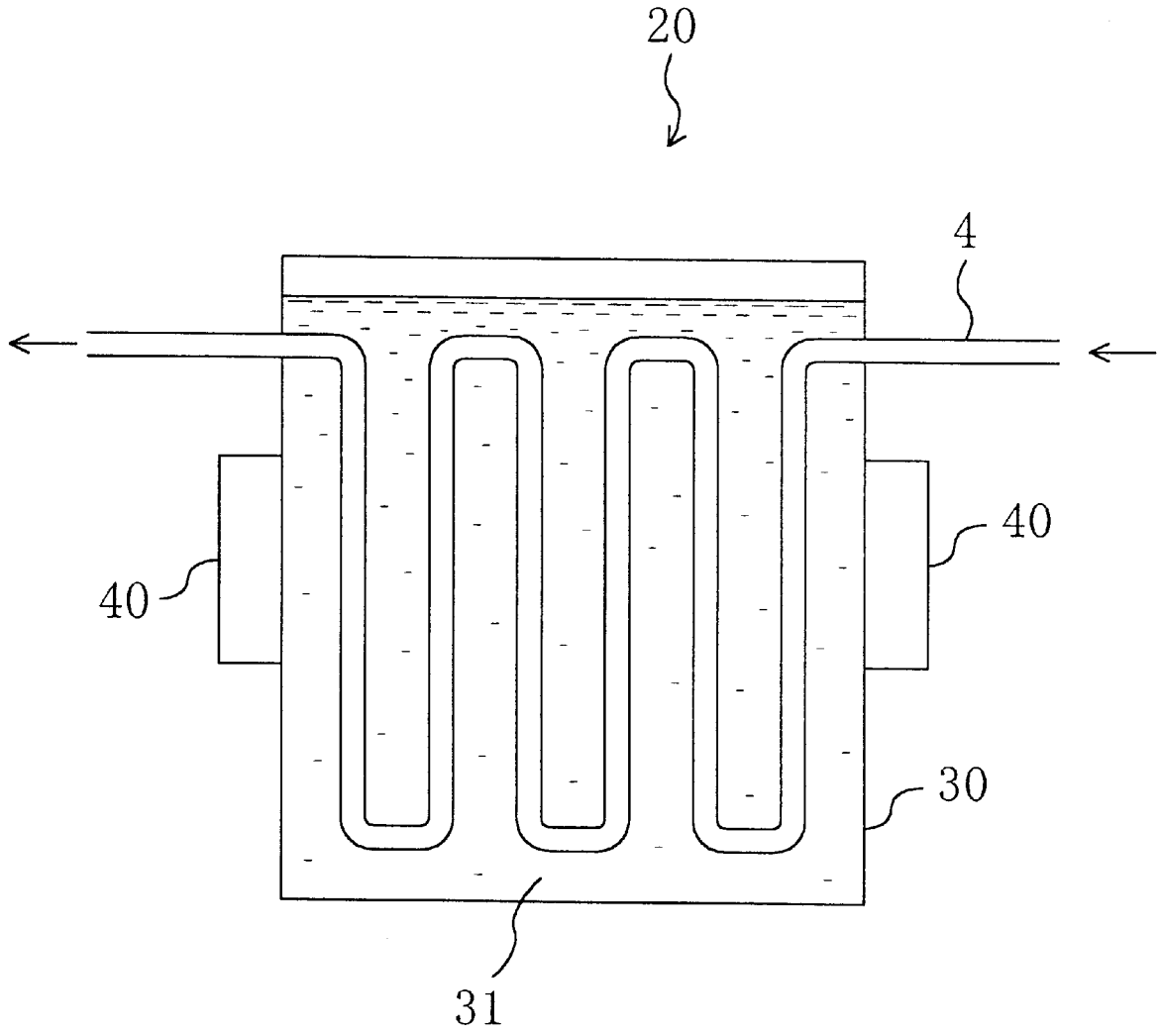
FIG. 2 shows a structure of an ultrasonic transmitting unit of FIG. 1.

FIG. 2 shows a structure of the ultrasonic transmitting unit 20 of FIG. 1. In FIG. 2, the slurry supply pipe 4 is installed to pass through pure water 31 filled in a water tab 30. An ultrasonic oscillator 40 generates an ultrasonic wave, which is transmitted sequentially through the water tab 30, the pure water 31, and the slurry supply pipe 4 to the polishing slurry 2A conveyed under pressure through the slurry supply pipe 4. The capacity of the slurry supply pipe 4 was adjusted such that the polishing slurry 2A traveled through the portion of the slurry supply pipe 4 immersed in the water tab 30 in about 1 minute in the case where the flow rate of the slurry was 200 mL/minute and the ultrasonic power was 100 W. The adjustment achieved the effect of re-dispersing the abrasive particles agglomerated in the polishing slurry 2A. Although the ultrasonic wave has been transmitted to the slurry supply pipe 4 through the water tab 30 and the pure water 31 in the foregoing description, the present embodiment is not limited thereto. It is also possible to dispose the ultrasonic oscillator 40 directly on the slurry supply pipe 4.

Thus, according to the first embodiment, the ultrasonic wave is transmitted to the polishing slurry 2A conveyed under pressure through the slurry supply pipe 4. As a result, the abrasive particles agglomerated in the polishing slurry 2A are satisfactorily re-dispersed till they are supplied from the slurry outlet 5 so that they are separated into individual forms prior to polishing. This suppresses a scratch on the surface of the semiconductor wafer 9 and stabilizes the polishing properties including the polishing rate.

EMBODIMENT 2

Figure 3:
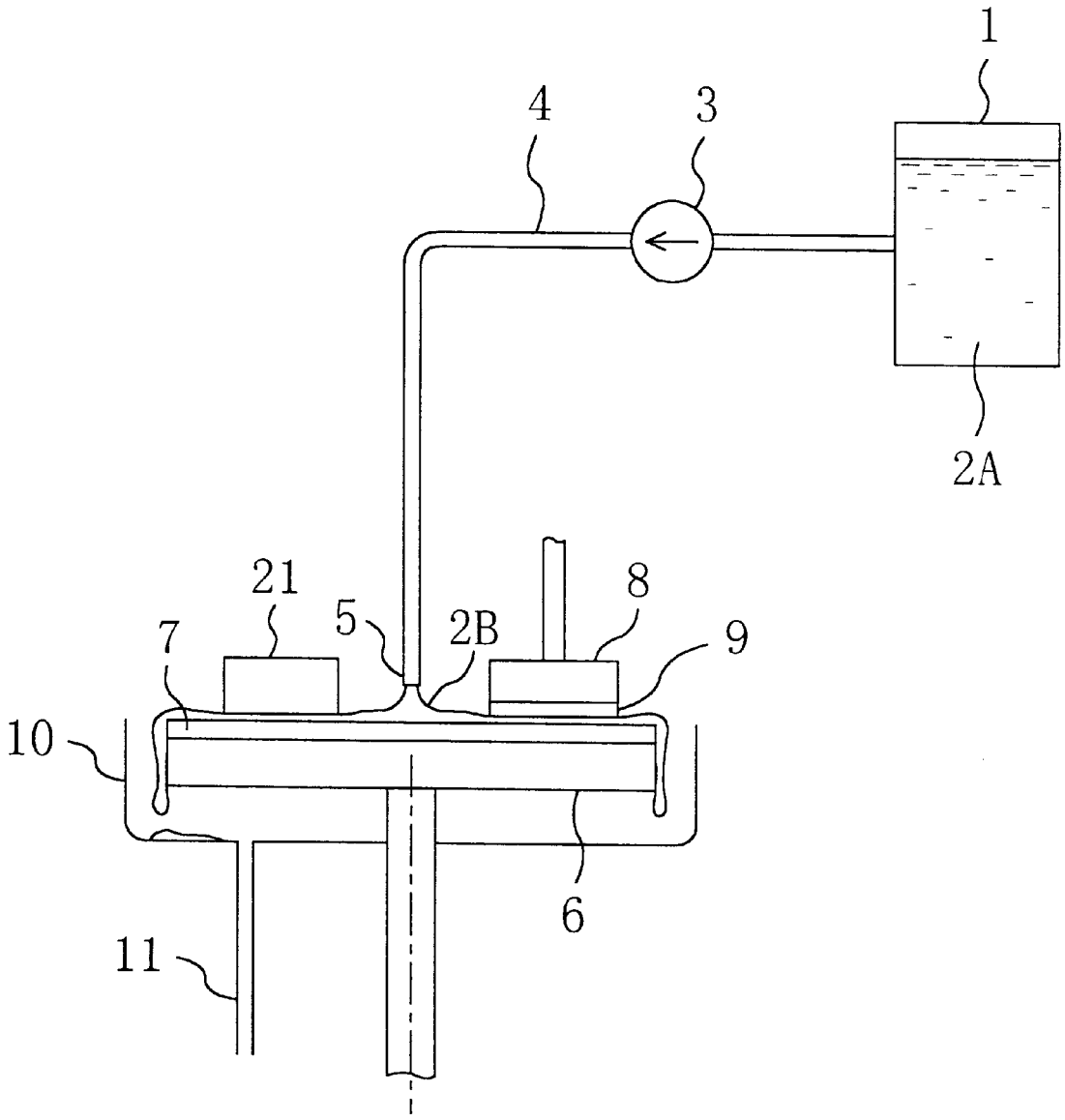
FIG. 3 shows a structure of an apparatus for polishing a semiconductor wafer to be used in a method of polishing a semiconductor wafer according to a second embodiment of the present invention.

A method of polishing a semiconductor wafer according to a second embodiment of the present invention will be described with reference to FIGS. 3 and 4. FIG. 3 shows a structure of an apparatus for polishing a semiconductor wafer to be used in the method of polishing a semiconductor wafer according to the second embodiment. The description of the same components as used in the conventional apparatus for polishing a semiconductor wafer will be omitted by providing the same reference numerals. An ultrasonic transmitting unit 21 diagrammatically shown in FIG. 3 is the ultrasonic transmitting means provided on the surface of the polishing cloth 7. The ultrasonic transmitting unit 21 generates an ultrasonic wave and transmits the generated ultrasonic wave to the surface of the polishing cloth 7.

Figure 4:
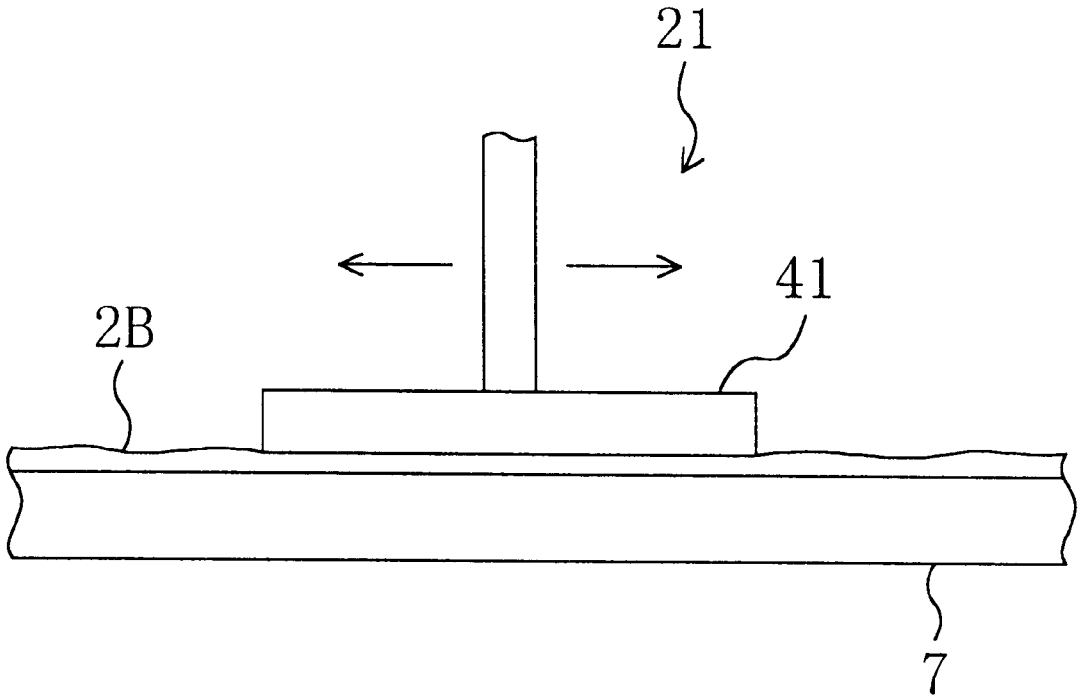
FIG. 4 shows a structure of an ultrasonic transmitting unit of FIG. 3.

FIG. 4 shows a structure of the ultrasonic transmitting unit 21 of FIG. 3, in which an ultrasonic oscillator 41 generates an ultrasonic wave. The generated ultrasonic wave is transmitted to the polishing cloth 7 coated with the polishing slurry 2B or moistened with pure water. When ultrasonic power on the order of 100 W was applied to the ultrasonic oscillator 41, the effect of re-dispersing the agglomerated abrasive particles was observed in either case where the ultrasonic oscillator 41 was operated simultaneously with the supply of the polishing slurry 2B to the surface of the polishing cloth 7 or with the washing of the polishing cloth 7 with pure water or the like. In addition, the agglomerated abrasive particles can be re-dispersed more effectively by constituting the ultrasonic oscillator 41 such that it sweeps the surface of the polishing cloth 7 at a given rate, as shown in FIG. 4. Although the ultrasonic wave has been transmitted directly to the surface of the polishing cloth 7 coated with the polishing slurry 2B or moistened with pure water, the present embodiment is not limited thereto. It is also possible to eject the polishing slurry or pure water from, e.g., a nozzle provided with the ultrasonic oscillator and transmit the ultrasonic wave to the surface of the polishing cloth 7 via the ejected polishing slurry or pure water.

Thus, according to the second embodiment, the ultrasonic wave is transmitted to the surface of the polishing cloth 7. As a result, the agglomerated abrasive particles in the polishing slurry 2B applied to the surface of the polishing cloth 7 or the agglomerated abrasive particles remaining on the surface of the polishing cloth 7 are effectively re-dispersed and separated into individual forms prior to polishing, during polishing, or after polishing. This suppresses a scratch on the surface of the semiconductor wafer 9 and stabilizes the polishing properties including the polishing rate.

EMBODIMENT 3

Figure 5:
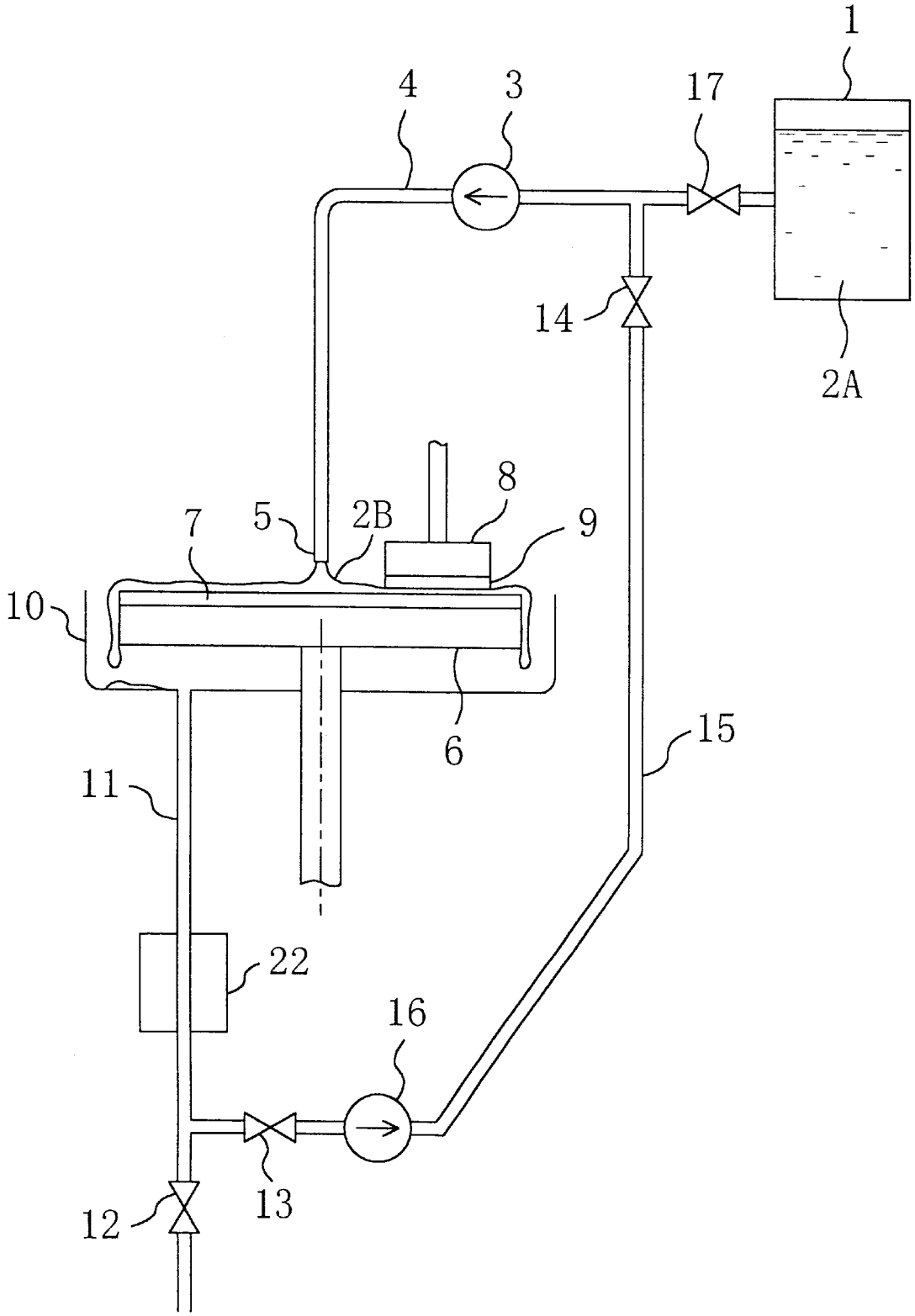
FIG. 5 shows a structure of an apparatus for polishing a semiconductor wafer to be used in a method of polishing a semiconduct or wafer according to a third embodiment of the present invention.

A method of polishing a semiconductor wafer according to a third embodiment of the present invention will be described with reference to FIGS. 5 and 6. FIG. 5 shows a structure of an apparatus for polishing a semiconductor wafer to be used in the method of polishing a semiconductor wafer according to the third embodiment. The description of the same components as used in the conventional apparatus for polishing a semiconductor wafer will be omitted by providing the same reference numerals. An ultrasonic transmitting unit 22 diagrammatically shown in FIG. 5 is the ultrasonic transmitting means provided on a portion of the discharged slurry pipe 11. A discharge valve 12 switches the path of the discharged slurry containing the polishing slurry 2B flowing through the discharged slurry pipe 11 between a discharge path and a recycle path. Recycle valves 13 and 14 are for selectively refluxing the discharged slurry to the slurry feed pump 3 or interrupting the reflux via a slurry recycle pipe 15 and a slurry recycle pump 16. The slurry recycle pump 16 is for conveying under pressure the discharged slurry supplied via the recycle valve 13 to the slurry feed pump 3 via the recycle valve 14. A feed valve 17 is for selectively supplying the polishing slurry 2A reserved in the slurry supply tank 1 to the slurry feed pump 3 or interrupting a flow of the polishing slurry 2A. (FIG.5)

A description will be given to the operation of the apparatus for polishing a semiconductor device shown in FIG. 5. The ultrasonic transmitting unit 22 generates an ultrasonic wave and transmits the generated ultrasonic wave to the discharged slurry flowing through the discharged slurry pipe 11 via the discharged slurry pipe 11. By closing the discharge valve 12 and the feed valve 17 and opening the recycle valves 13 and 14, the slurry recycle pipe 15 forming the recycle path extending from the discharged slurry pipe 11 to the slurry feed pump 3 is opened. In the slurry recycle pipe 15 which has been opened, the slurry recycle pump 16 conveys the discharged slurry containing the polishing slurry 2B under pressure such that it is supplied to the slurry feed pump 3. Although the recycled polishing slurry has been supplied directly to the slurry feed pump 3 via the slurry recycle pipe 15 in the foregoing description, the present embodiment is not limited thereto. It is also possible to provide, e.g., a reservoir for reserving the polishing slurry in a portion of the slurry recycle pipe 15.

Figure 6:
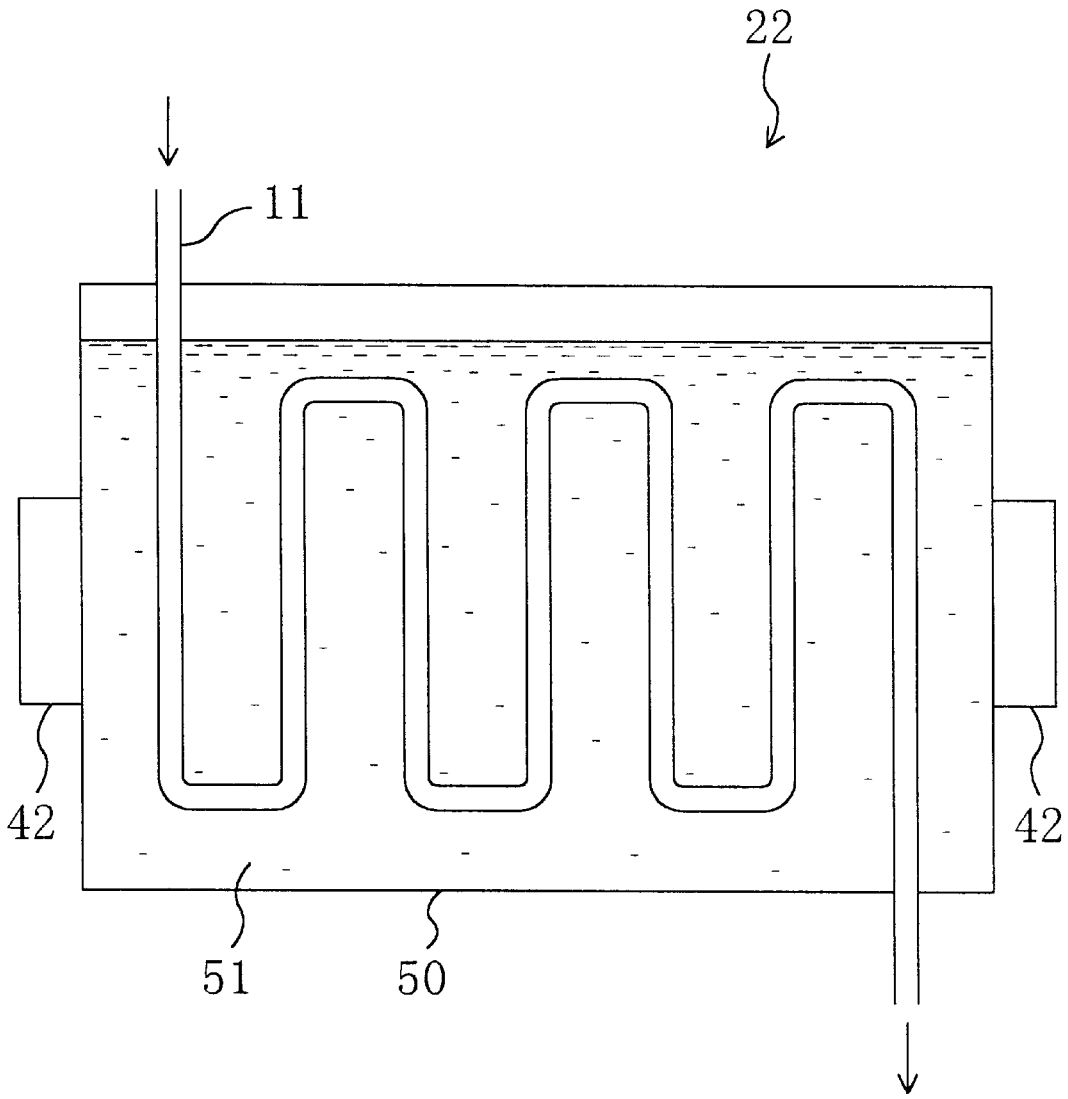
FIG. 6 shows a structure of an ultrasonic transmitting unit of FIG. 5.
Figure 7:
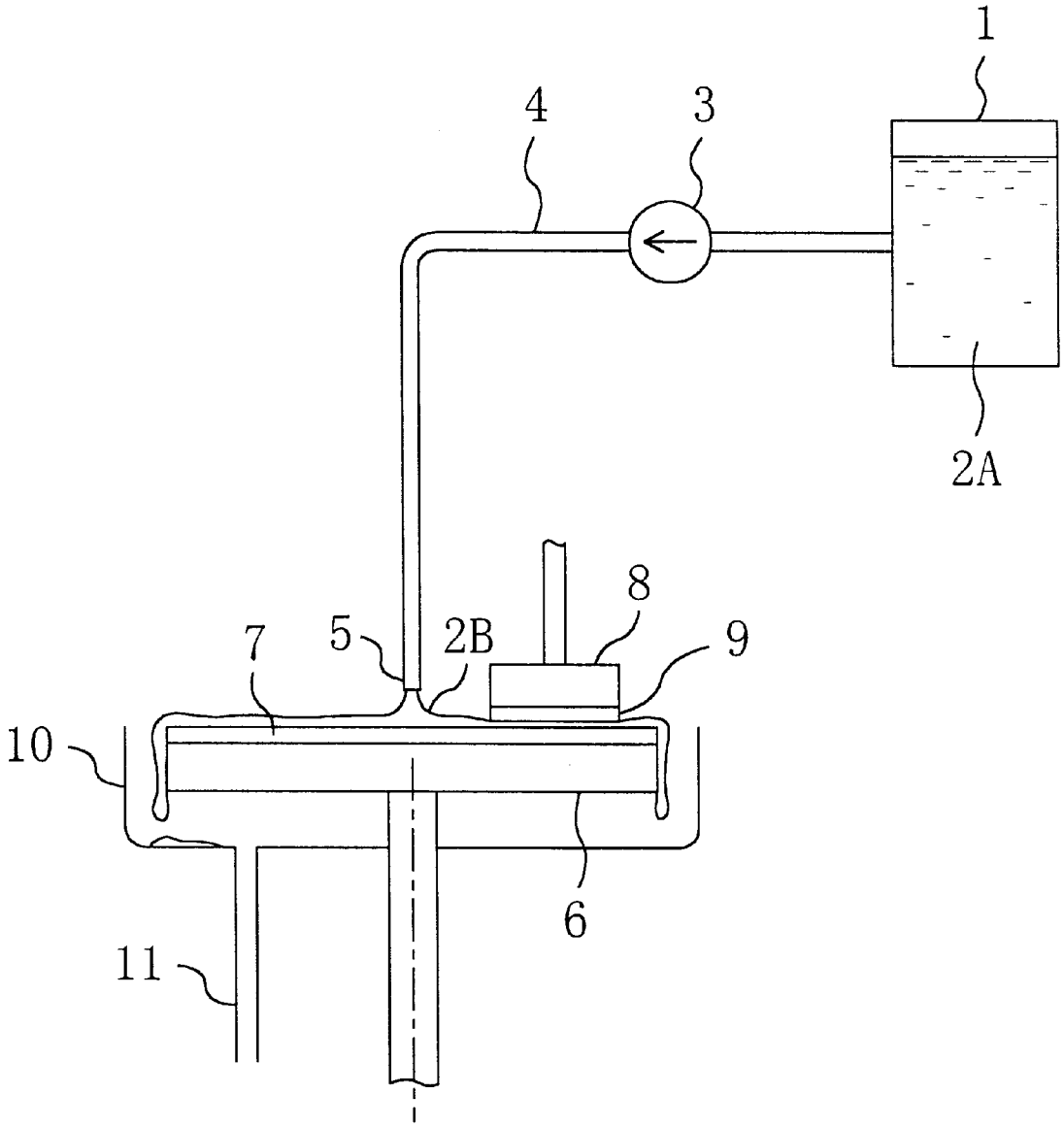
Fig. 7 Prior Art
FIG. 7 shows a structure of a conventional apparatus for polishing a semiconductor wafer.
Figure 8:
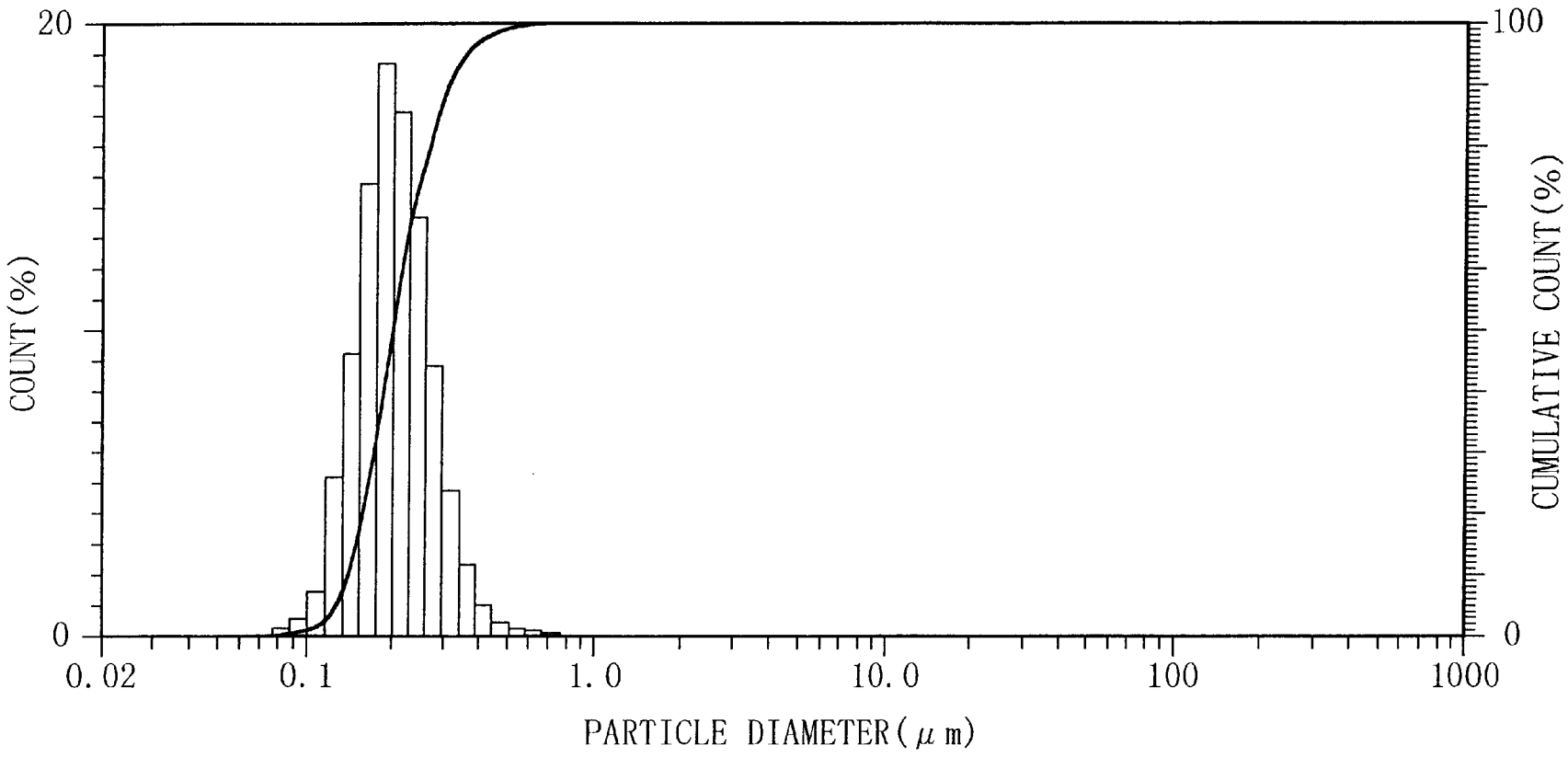
Fig. 8 Prior Art
FIG. 8 shows the distribution of the diameters of particles in a polishing slurry charged into a slurry supply tank of the apparatus for polishing a semiconductor wafer of FIG. 7.
Figure 9:
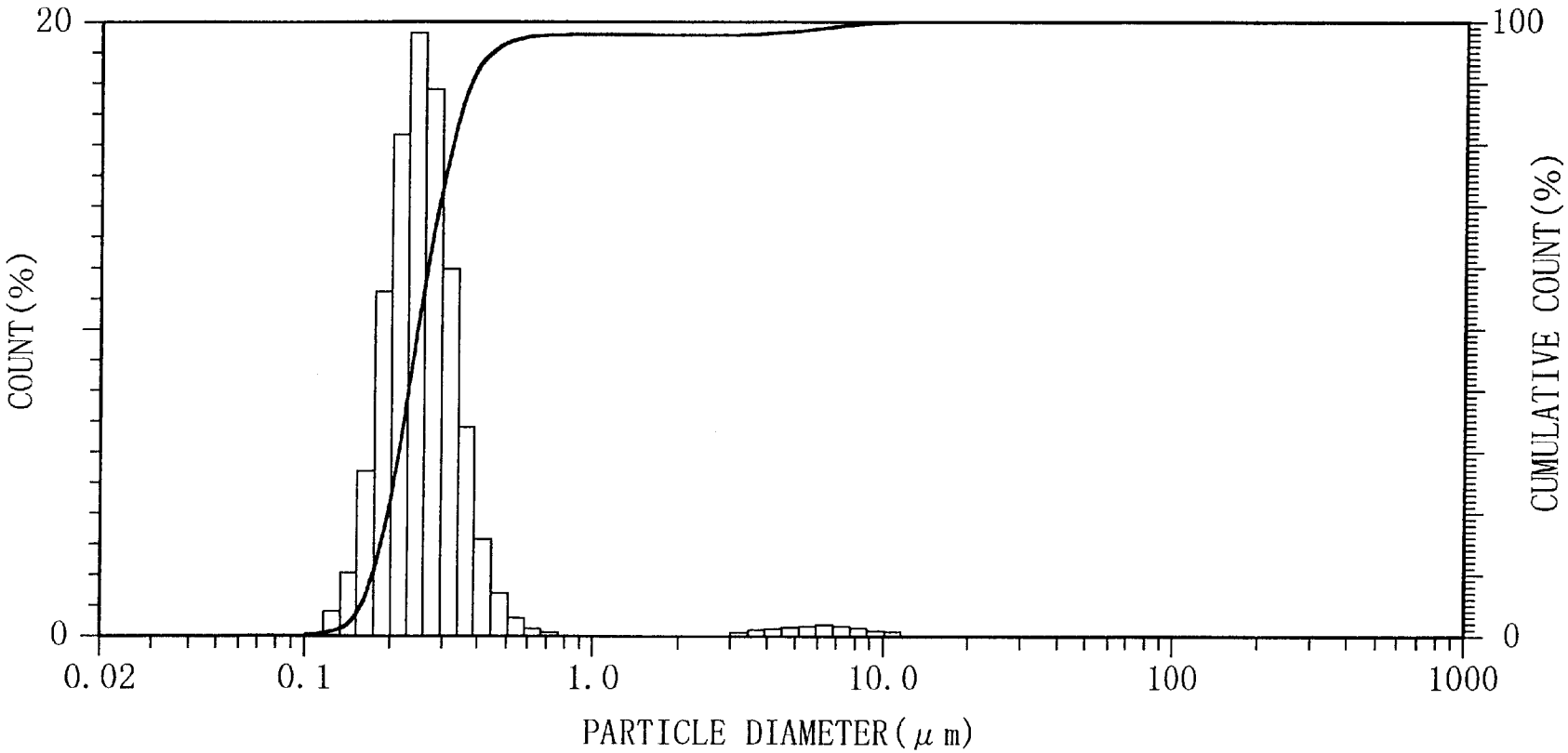
Fig. 9 Prior Art
FIG. 9 shows the distribution of the diameters of particles in the polishing slurry collected from a slurry outlet of the apparatus for polishing a semiconductor wafer of FIG. 7.
Figure 10:
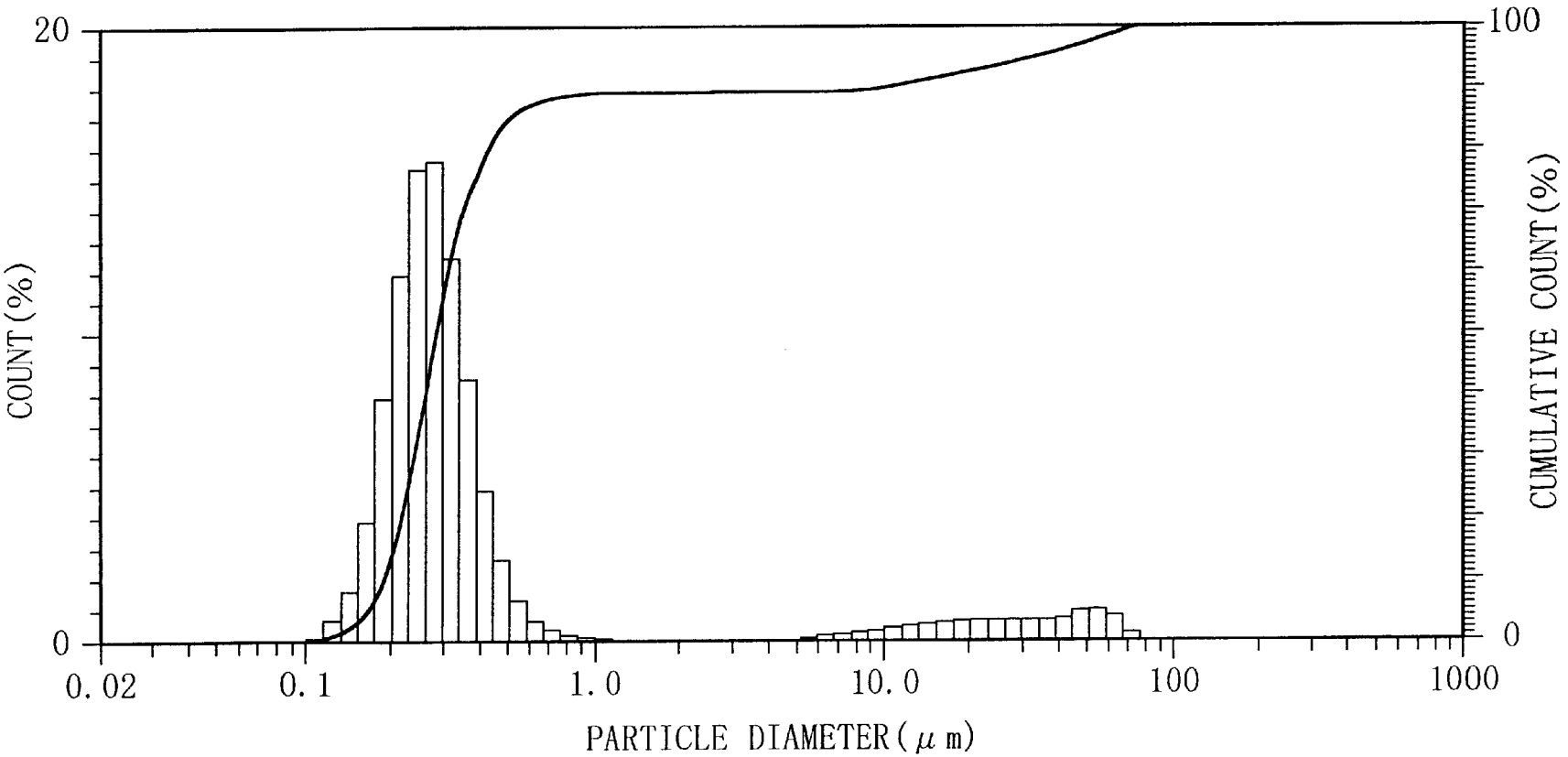
Fig. 10 Prior Art
FIG. 10 shows the distribution of the diameters of particles remaining on the surface of a polishing cloth used to polish a plurality of silicon wafers with respective oxide films by the apparatus for polishing a semiconductor wafer of FIG. 7.

FIG. 6 shows a structure of the ultrasonic transmitting unit 22 shown in FIG. 5. In FIG. 6, the discharged slurry pipe 11 is installed to pass through pure water 51 filled in a water tab 50. An ultrasonic oscillator 42 generates an ultrasonic wave, which is transmitted sequentially through the water tab 50, the pure water 51, and the discharged slurry pipe 11 to the discharged slurry flowing through the discharged slurry pipe 11. The capacity of the discharged slurry pipe 11 was adjusted such that the discharged slurry traveled through the portion of the discharged slurry pipe 11 immersed in the water tab 50 in about 1 minute in the case where the flow rate of the slurry was 200 mL/minute and the ultrasonic power was 100 W. The adjustment achieved the effect of re-dispersing the abrasive particles agglomerated in the discharged slurry.

Thus, according to the third embodiment, the discharged slurry containing the polishing slurry 2B is supplied to the slurry feed pump 3 via the slurry recycle pipe 15 after the ultrasonic wave is transmitted to the discharged slurry. As a result, the abrasive particles agglomerated in the discharged slurry are satisfactorily re-dispersed after polishing, which allows the discharged slurry to be reused for polishing. This suppresses a scratch on the surface of the semiconductor wafer 9, stabilizes the polishing properties including the polishing rate, and reduces the amount of the polishing slurry consumed and discharged through effective use of the discharged slurry.

It is to be noted that the first to third embodiments described above are also applicable to the process of manufacturing a semiconductor wafer made of, e.g., silicon or to the process of manufacturing a semiconductor integrated circuit formed on the semiconductor wafer. It will be appreciated that the first to third embodiments may also be used appropriately in combination.

What is claimed is:

1. A method of polishing a semiconductor wafer using a polishing slurry having abrasive particles therein, said method comprising the steps of:

supplying said polishing slurry from a tank for reserving said polishing slurry to a surface of a polishing cloth via a supply path;

pressing a surface of said semiconductor wafer against the surface of said polishing cloth supplied with said polishing slurry, moving said semiconductor wafer relative to said polishing cloth, and thereby polishing the surface of said semiconductor wafer;

discharging a discharged slurry flown out of the surface of said polishing pad via a discharge path and refluxing the discharged slurry to a portion of said supply path, said portion being positioned downstream from an outlet of said tank; and applying an ultrasonic oscillation to said discharged slurry on said discharge path, wherein said discharged slurry does not comprise any unused slurry from said tank.

2. A method of polishing a semiconductor wafer according to claim 1, wherein said step of applying said ultrasonic oscillation includes re-dispersing the agglomerated abrasive particles in said discharged slurry with the application of said ultrasonic oscillation to said discharged slurry.

3. A method of polishing a semiconductor wafer according to claims 1, wherein said discharged slurry is not mixed with said polishing slurry during said refluxing of the discharged slurry to a portion of said supply path.

* * * * *